US006029414A

United States Patent [19]

MacLeod

[11] Patent Number: 6,029,414

[45] Date of Patent: Feb. 29, 2000

[54] SEISMIC FIXTURE CLAMP

[76] Inventor: Frank A. MacLeod, 5188 Willow St., Vancouver, British Columbia, Canada, V5Z 3R9

[21] Appl. No.: 09/048,056

[22] Filed: Mar. 26, 1998

Related U.S. Application Data

[63] Continuation-in-part of application No. 08/974,198, Nov. 19, 1997.

[51] Int. Cl.[7] ..... E04B 2/00

[52] U.S. Cl. ..... 52/506.07; 52/39; 52/167.1; 52/202; 248/231.81; 248/317; 248/342; 248/343

[58] Field of Search ..... 52/39, 202, 506.07, 52/167.1; 248/342, 343, 317, 231.81

[56] References Cited

U.S. PATENT DOCUMENTS

| | | | |
|---|---|---|---|
| 3,516,389 | 6/1970 | Meyer | 119/417 |
| 4,449,343 | 5/1984 | Henningsen | 52/404 |
| 4,479,341 | 10/1984 | Schuplin | 52/665 |
| 5,349,800 | 9/1994 | Peng | 52/506.06 |
| 5,369,928 | 12/1994 | Goodworth | 52/506.08 |
| 5,428,930 | 7/1995 | Bagley et al. | 52/506.07 |
| 5,609,007 | 3/1997 | Eichner | 52/747.1 |
| 5,611,185 | 3/1997 | Wilz | 52/506.07 |
| 5,619,833 | 4/1997 | Neff | 52/506.07 |

*Primary Examiner*—Christopher T. Kent
*Assistant Examiner*—Nkeisha J. Maddox
*Attorney, Agent, or Firm*—Oyen Wiggs Green & Mutala

[57] ABSTRACT

A seismic fixture clamp enables light fixtures and the like to be securely affixed to the T-bars of a suspended ceiling system, thereby ensuring that the fixtures do not separate from the T-bars in the event of an earthquake generating seismic shocks to the suspended ceiling system. The seismic fixture clamp, although easily and quickly installed, adds structural strength to the overall T-bar framework to reduce or prevent twisting and separating of the T-bars, and includes support lips configured to securely affix light fixtures to the T-bars, thereby strengthening the suspended ceiling system against seismic shocks without requiring additional wires or chains to secure the fixtures directly to an overhead structure.

11 Claims, 5 Drawing Sheets

SEISMIC FIXTURE CLAMP

This application is a continuation-in-part of application Ser. No. 08/974,198, filed Nov. 19, 1997.

FIELD OF THE INVENTION

This invention relates to a seismic fixture clamp for securing fixtures to the cross bars of suspended ceiling systems. More particularly, this invention pertains to a novel seismic fixture clamp which enables light fixtures and the like to be securely affixed to the T-bars of suspended ceiling systems thereby ensuring that the lighting fixtures do not separate from the T-bars in the event of an earthquake generating seismic shocks to the suspended ceiling system.

BACKGROUND OF THE INVENTION

Currently, in earthquake areas such as California, Oregon, Washington and British Columbia, Canada, building codes require that light fixtures be "seismic proofed" by securing the fixtures with strong metal wires or chains to overhead beams and the like. The British Columbia Building Code permits a maximum of 12 inches of drop for a light fixture in a suspended ceiling. Installing wires and chains to secure light fixtures in suspended ceilings is an expensive and time-consuming process. Also, in many cases, installing wires or chains is difficult because the overhead beams to which the wires and chains must be secured are many feet away. In some cases, there is nothing solid to which the wires or chains can be secured.

A number of patents have been issued over the years disclosing brackets, dampers, frames, and the like for use in securing various objects against high wind, seismic activity, and the like.

| U.S. Pat. No. | Inventor |
|---|---|
| 4,720,944 | Loicq |
| 4,073,107 | Rousseau |
| 4,472,916 | Krebs |
| 4,531,334 | Nylander et al. |
| 5,163,256 | Fukumoto et al. |
| 5,383,723 | Meyer |

Of these, Rousseau discloses a bracket for use on a curtain wall in a building. The bracket compensates for forces generated by high wind and the like. Nylander et al. disclose an earthquake-proof construction bracket. Fukumoto et al. disclose a seismic damper for a building structure. Meyer discloses an earthquake resistant electronic equipment frame.

SUMMARY OF THE INVENTION

The subject invention provides a simple and inexpensive way to secure the lighting fixture to an existing T-bar and suspension wire system of a typical suspended ceiling system. The invention also adds structural strength to the overall T-bar framework. The invention involves clamps that are easy and quick to install, thereby reducing labour cost. Also, the system can be used in situations where it is not possible to connect the fixture by chains or the like to an overhead structure.

The invention is directed to a seismic fixture clamp for use in affixing fixtures to T-bars of a suspension ceiling system comprising: (a) a first front wing; (b) a second front wing connected to and extending at right angles to the first front wing; (c) a second front wing connected to and spaced from the first front wing; (d) a second back wing connected to and spaced from the first back wing, said second back wing extending at right angles from the first front wing and first back wing; (e) a first support lip extending inwardly in the direction of the second front wing, to the interior of the right angle, connected to the base of the first front wing; and (f) a second support lip extending inwardly in the direction of the first front wing to the interior of the right angle connected to the base of the second front wing.

The elevation of the second support lip can be above the elevation of the first support lip. The first front wing and the first back wing can be connected together in the form of an inverted "U". The second front wing and the second back wing can be connected together in the form of an inverted "U".

The first support lip can be positioned at an elevation above the second support lip to form a space between the first support lip and the second support lip. The first front wing can be parallel with the first back wing and the second front wing can be parallel with the second back wing.

Aligned holes can be present in the first front wing and first back wing, and the second front wing and the second back wing. Aligned stabilizer wire holes can also be present in the first front wing and first back wing and/or the second front wing and second back wing.

In a second embodiment, the clamp can have a "T-shape" with a base first and second back wing, and a pair of oppositely and perpendicularly extending first and second front wings.

BRIEF DESCRIPTION OF DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
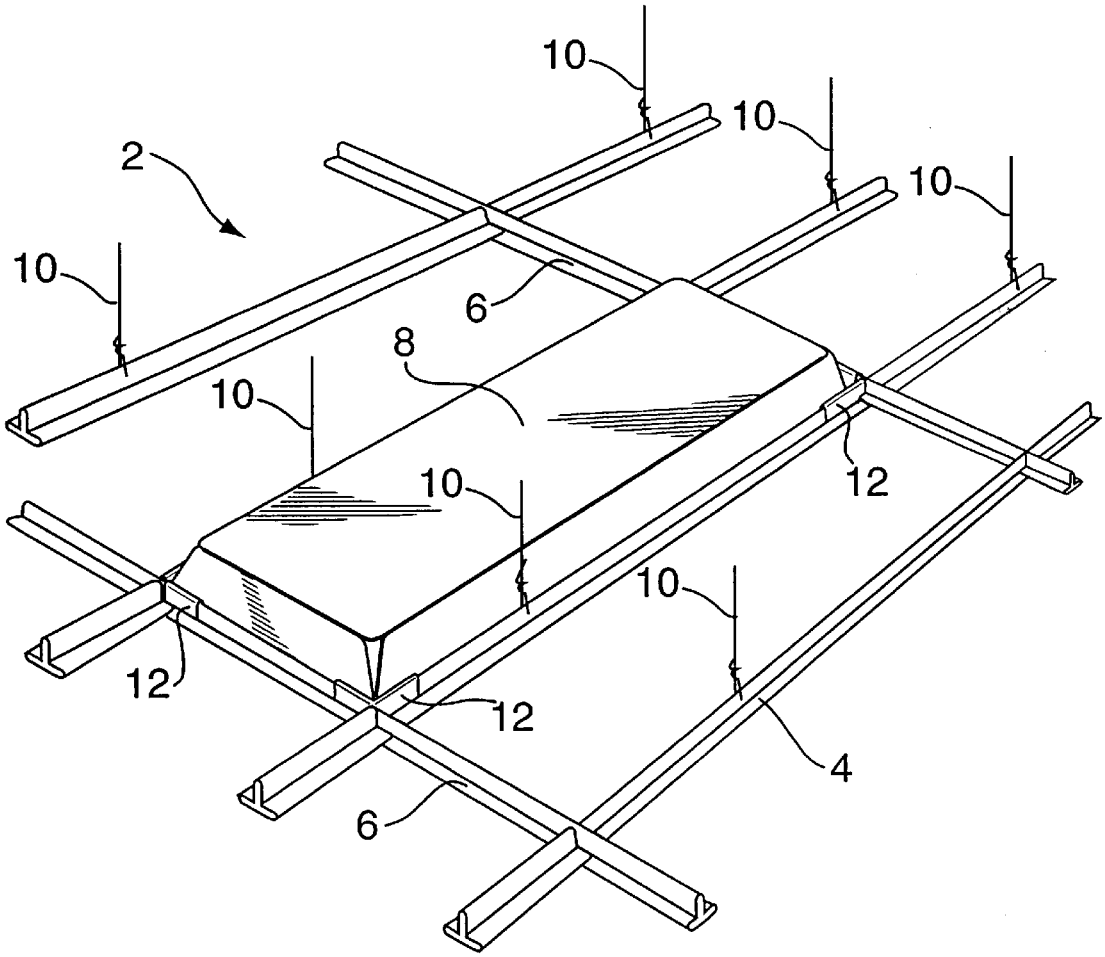
FIG. 1 illustrates an isometric sketch of four seismic fixture clamps, according to the invention, installed at the four corners of a rectangular lighting fixture held on an intersecting grid of T-bars suspended by wires, which is a typical suspended ceiling system.

Referring to the drawings, FIG. 1 illustrates an isometric sketch of four seismic fixture clamps installed at the four corners of a lighting fixture held on an intersecting grid of T-bars suspended by wires, which is a typical suspended ceiling system. Specifically, FIG. 1 illustrates an isometric sketch of a suspended ceiling system 2, constructed in a rectangular grid of intersecting right angle longitudinal inverted T-bars 4 and lateral inverted T-bars 6. The longitudinal T-bars 4 and lateral T-bars 6 are typically spaced in a grid-like pattern to accommodate the dimensions of standard size lighting fixtures, and other conventional suspended ceiling equipment. A typical fluorescent light fixture 8 is positioned in one of the rectangles created by the intersecting longitudinal T-bars 4 and lateral T-bars 6. Typical fluorescent light fixtures are 1 ft.×4 ft., or 2 ft.×4 ft. in dimension. The gridwork formed by the intersecting longitudinal T-bars 4 and lateral T-bars 6 is suspended from a stationary fixed ceiling (not shown) by a series of suspension wires 10, which twist fastened in holes drilled in the vertical stems of the longitudinal T-bars 4 and lateral T-bars 6. The wires 10 are typically secured to the T-bars 4 and 6 at a distance from the right angle intersection created by the longitudinal T-bars 4 and lateral T-bars 6. As seen in FIG. 1, four seismic fixture clamps 12 are located at the four corners of the rectangular light fixture 8.

Figure 2:
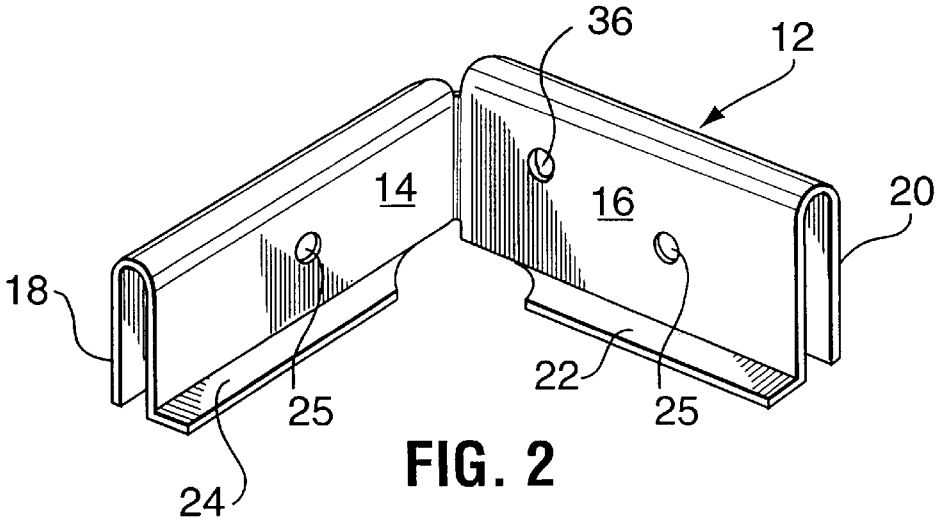
FIG. 2 illustrates an isometric sketch of the seismic fixture clamp. The clamp is shaped in a right angle configuration and has two inverted "U"-shaped arms which fit over the right angle intersection bars of the T-bar system.

FIG. 2 illustrates an isometric sketch of the seismic fixture clamp. The clamp 12 is shaped in a right angle configuration and has two inverted "U"-shaped wings 14 and 16 which fit over the upright stems of the right angle intersections of the inverted T-bar system. The back corner of the seismic fixture clamp 12 is open so that it fits over the intersecting T-bar.

The respective bases of the two wings 14 and 16 of the seismic fixture clamp 12 have right angle inwardly extending horizontal lips 22 and 24. The long lip 24 at the base of one wing 14 fits over the flat rim of the corner of a typical lighting fixture 8 (see rim 32 in FIG. 6). The short lip 22 at the base of the other wing 16 fits under the adjacent flat corner rim of the lighting fixture 8. The holes 25 in each wing 14 and 16 permit metal screws (see screw 34 in FIG. 6) to penetrate the walls of the inverted wings 14, 16, 18 and 20 and draw the two walls together to secure the T-bar. The screw 34 does not penetrate or fasten to the light fixture 8.

FIG. 2, in particular, illustrates an isometric view of a right angle seismic fixture clamp 12 which is formed of a first front wing 14, a second front wing 16, positioned at a right angle to the first front wing 14, a parallel first back wing 18, parallel with the first front wing 14, and a second back wing 20, parallel with the second front wing 16. A first front lip 24, which extends horizontally and inwardly from the base of the first front wing 14, and a second lip 22 which extends horizontally and inwardly from the second front wing 16, are adapted to fit with and affix the framing rim 30 of a standard light fixture 8 (see FIG. 1). This will be explained in more detail below in association with FIG. 6. The space between the first front wing 14 and first back wing 18 is dimensioned to fit over the upright stem of a standard T-bar 4 of a suspended ceiling system (see FIG. 1). Similarly, the second back wing 20 is spaced from the second front wing 16 to also fit over the vertical stem of an intersecting right angle T-bar of a standard suspended ceiling system.

FIG. 2 also illustrates a wire hole 36 in the second front wing 16 which can be used for installing stabilizing wires (not shown). The stabilizing wires will be explained in detail below in association with FIG. 7.

Figure 3:
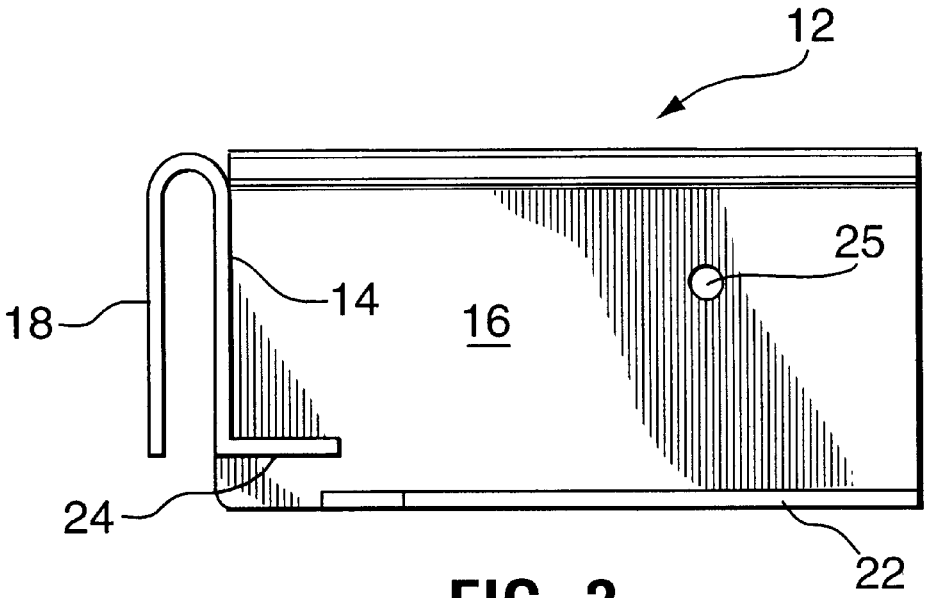
FIGS. 3 and 4 illustrate respectively end and top views of the seismic clamp.
Figure 4:
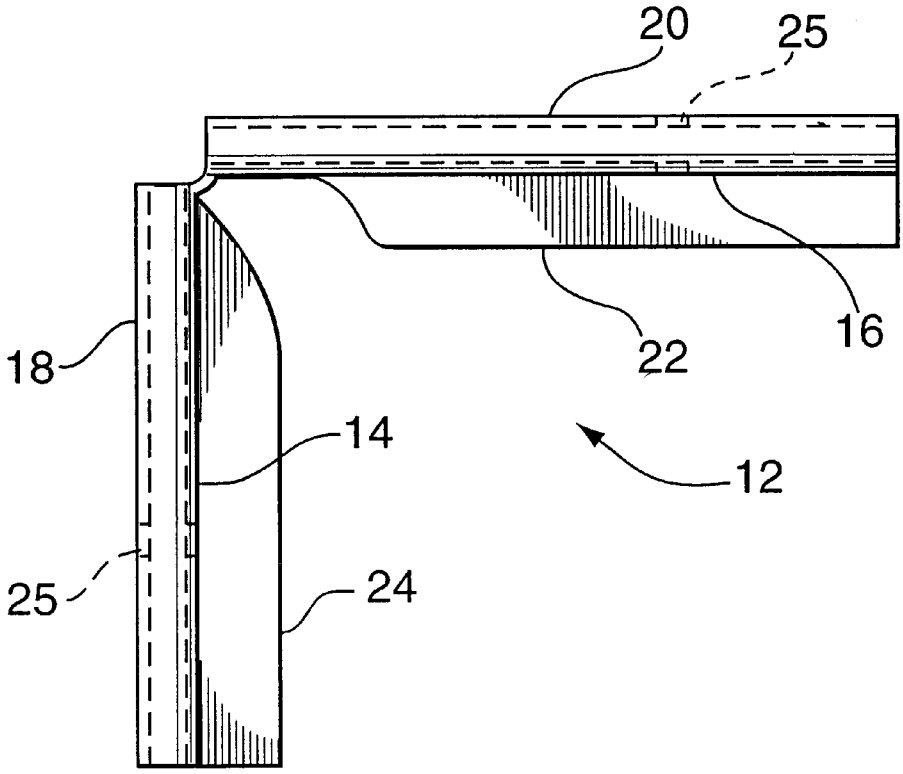

FIGS. 3 and 4 illustrate respectively end and top views of the seismic fixture clamp 12. FIG. 3 shows the manner in which the first back wing 18 is spaced from and parallel with the first front wing 14 to form an inverted "U" configuration, which is adapted to fit over the vertical stem of a standard suspended ceiling T-bar (see FIG. 6). FIG. 3 also illustrates how the first lip 24 extends inwardly and horizontally to the right from the base of first front wing 14. The face of second front wing 16 has at the base thereof second lip 22 which also extends inwardly to the interior of the right angle in the same manner as first lip 24. It is important to note that the elevation of first lip 24 is positioned and spaced above the elevation of second lip 22. The difference in elevation between lip 22 and lip 24 is sized to fit the thickness of the framing light rim 32 of a standard light fixture 8, as will be further illustrated and discussed below in association with FIG. 6. Screw hole 25 is also shown in FIG. 3.

As seen in FIG. 4, which shows a top view of the seismic fixture clamp 12, the rear exterior corner of the intersection between the first front wing 14 and first back wing 18, and the second front wing 16 and second back wing 20, is cut away. This enables the seismic fixture clamp 12 to receive and fit over the stems of the longitudinal and lateral T-bars at the intersection between these T-bars, as shown in FIG. 1. As can also be seen in FIG. 4, the first lip 24 extends inwardly to the interior and to the right (as seen in FIG. 4) from the base of first front wing 14, while the second lip 22 extends to the interior and downwardly (as seen in FIG. 4) from the base of second front wing 16. The screw holes 25 are shown in dotted configuration in the two wings 14 and 16.

It will be understood that the seismic fixture clamp 12 as illustrated in FIGS. 3 and 4 can be reversed in configuration to provide a left-hand configuration instead of a right hand configuration to fit specific situations.

Figure 5:
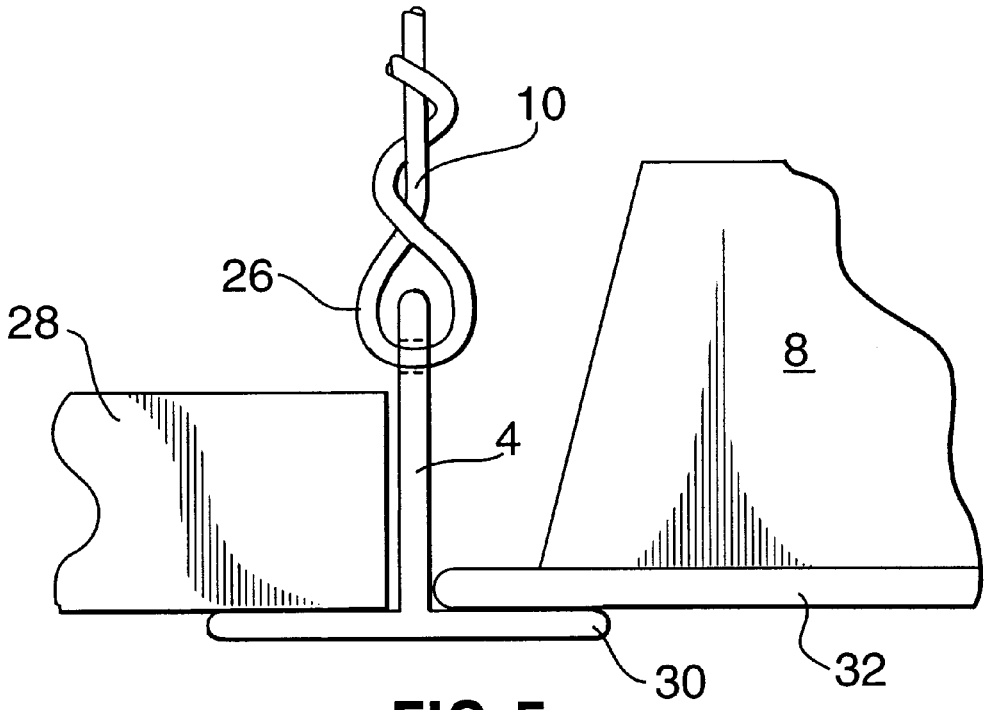
FIG. 5 illustrates an end section view of a typical T-bar holding the edges of adjacent ceiling panels.

FIG. 5 illustrates an end section view of a typical T-bar 4 holding the edge of a ceiling panel 28 on one side (the left side as seen in FIG. 5) and the frame rim 32 of a light fixture 8 (on the right side as seen in FIG. 5). As particularly seen in FIG. 5, the stem of the inverted longitudinal T-bar 4 is suspended by a suspension wire 10, the lower end 26 thereof being hooked through a hold in the stem of the inverted T-bar 4, and then twist-tied to wire 10 above the stem of the T-bar 4. The left portion of horizontal cross-bar 30 at the base of the stem supports thereon the edge of a standard ceiling tile 28. As shown in FIG. 5, the upper face of the right horizontal portion of the cross-bar 30 supports the framing light rim 32 of a standard light fixture 8. This arrangement is typical in most suspended ceiling systems.

Figure 6:
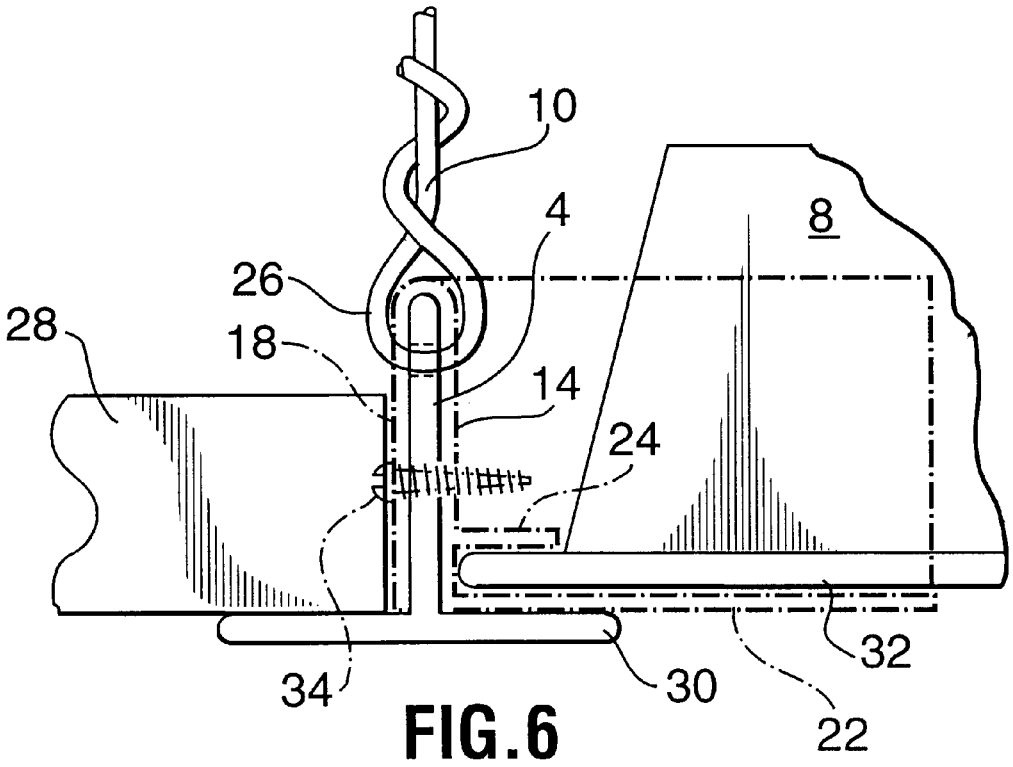
FIG. 6 illustrates an end section view of a T-bar holding the edge of a ceiling panel on one side and the edge of a light fixture on the opposite side. The installed seismic clamp is shown in cross-hatching.

FIG. 6 is similar to FIG. 5 and illustrates an end section view of an inverted T-bar 4 holding the edge of a ceiling panel 28 on one side (the left side) and the edge rim 32 of a light fixture 8 on the opposite right side. The installed seismic fixture clamp 12 is shown in cross-hatching. A comparison of FIG. 6 to FIG. 5 (which shows an existing suspended ceiling system without the fixture clamp 12 of the invention) demonstrates the manner in which the seismic fixture clamp 12 (shown in dotted lines) enables the light fixture 8, and its framing light rim 32, to be secured to the longitudinal inverted T-bar 4 to render the light fixture 8 seismic-proof. As seen in FIG. 6, the inverted "U" created by the first front wing 14 and the first back wing 18 fit snugly over the vertical stem of the inverted longitudinal T-bar 4. The first lip 24 fits over the edge of the light rim 32 of light fixture 8, while the second lip 22 fits under the light rim 32. This combination of first and second lips 24, 22 grips the rim 32 of the light fixture 8 and prevents the light fixture 8 from moving either up or down in relation to the T-bar 4. To further secure the seismic fixture clamp 12 to the T-bar 4, a metal screw 34 is screwed through the hole 25 in the front wing 14 and back wing 18 of the clamp 12.

In a typical suspended ceiling system, four seismic fixture clamps 12 are fitted at the four intersections of the T-bars 4 enclosing the rectangular conventional light fixture 8, as illustrated in FIG. 1. The presence of four clamps 12 for each light fixture 8, and the manner in which the lips 22, 24 of the clamp 12 fit about the light fixture rim 32 at four different locations, prevents the light fixture 8 from moving away from and separating from the T-bar framework. The combination of the four clamps 12 per fixture 8, together with the securing screws 34, prevent the T-bars from twisting or expanding and thus releasing the fixtures so that they fall to the floor.

Figure 7:
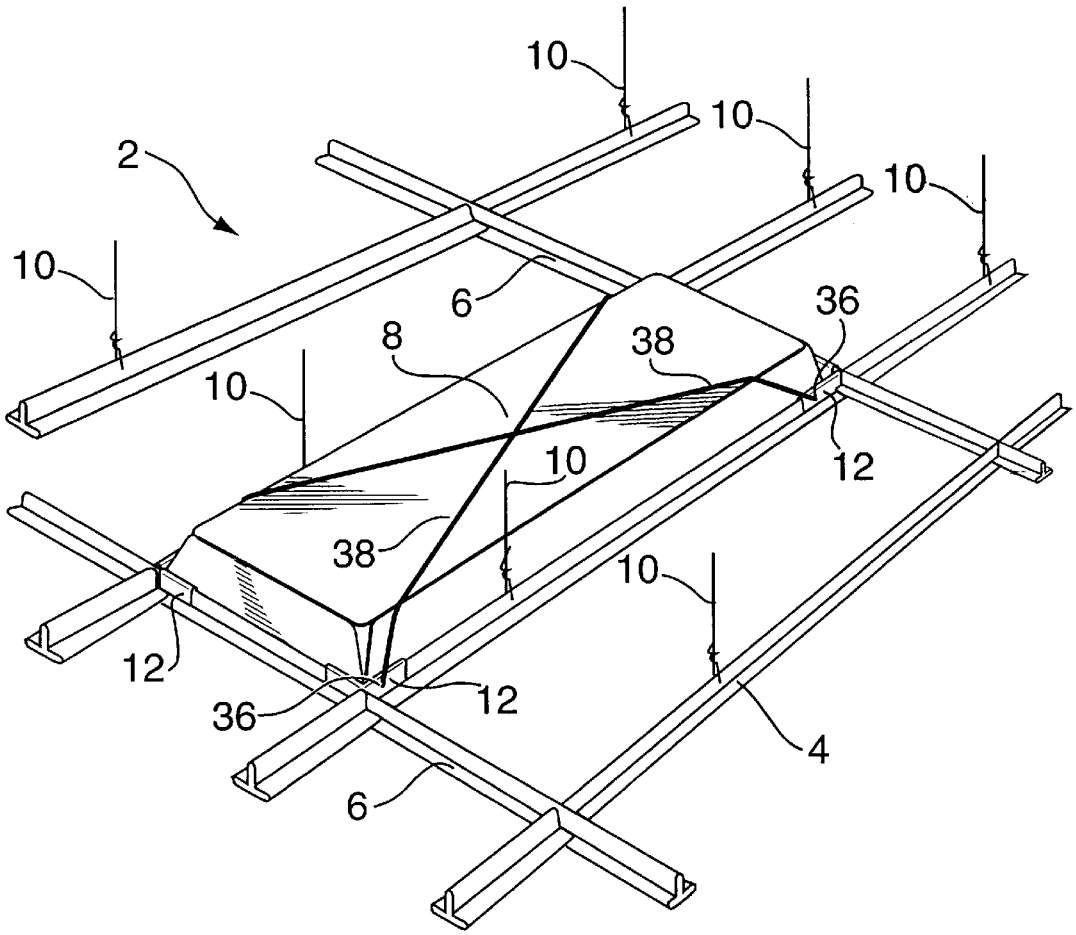
FIG. 7 illustrates an isometric view of four seismic fixture clamps, installed at the four corners of a rectangular lighting fixture held on a wire suspended intersecting grid of T-bars by a criss-crossing pair of stabilizing wires.

FIG. 7 illustrates an isometric view of four seismic fixture clamps, installed at the four corners of a rectangular lighting fixture held on a wire suspended intersecting grid of T-bars by a crisscrossing pair of stabilizing wires. In many retrofit situations, the rectangular light fixtures are of an outdated design that do not have a light rim extending around the lower circumference of the light fixture. In other words, the light rim 32 illustrated in FIGS. 5 and 6 is absent. The body of the old-style light fixtures abuts the inverted T-bars. In such a situation, it is not possible for the second lip 24 to grip the light fixture. The lip 24 must be bent away. In its place, in order to secure the old style light fixture to the T-bar grid work, a pair of criss-crossing stabilizing wires 38 are installed across the top of the old-style light fixture 8. The ends of the stabilizing wires 38 are wired through the wire holes 36 in each fixture clamp, as shown in FIG. 7.

Figure 8:
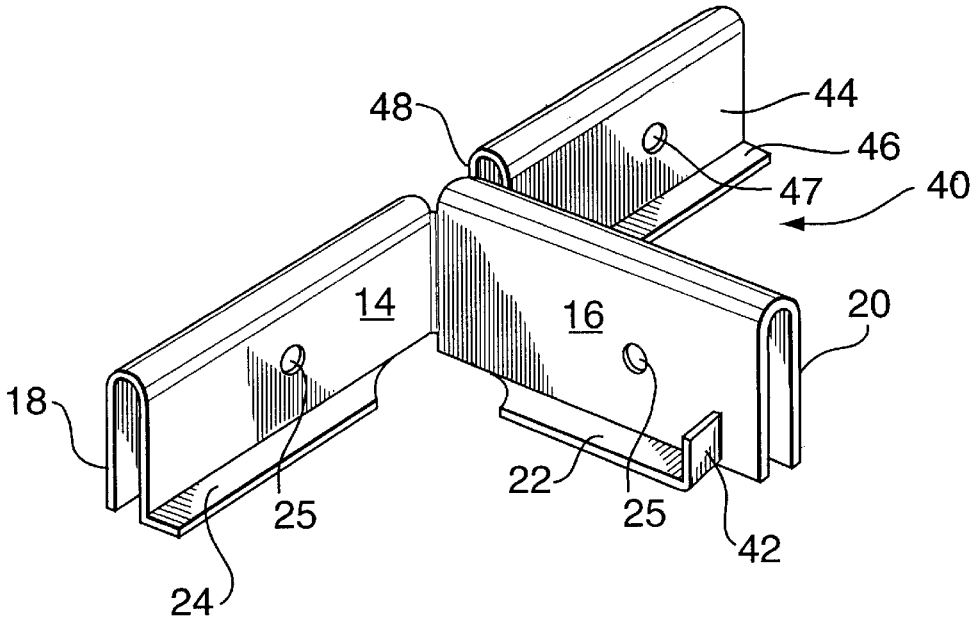
FIG. 8 illustrates an isometric sketch of an alternative "T-shape" embodiment of the seismic fixture clamp.

FIG. 8 illustrates an isometric view of a second embodiment of the invention, namely a T-shape seismic fixture clamp 40 which is formed of a first front wing 14, a second front wing 16, positioned at a right angle to the first front wing 14, a parallel first back wing 18, parallel with the first front wing 14, a second back wing 20, parallel with the second front wing 16, and a third front wing 44 extending from the same end of the back wing 16 opposite to the first front wing 14. A third back wing 48 extends parallel with the third front wing 44. A third lip 46 extends from the base of third front wing 44. A hole 47 penetrates the third front 44 and back wings 48. The first front lip 24, which extends horizontally and inwardly from the base of the first front wing 14, the second lip 22 which extends horizontally and inwardly from the second front wing 16 and the third lip 46 which extends from the third front wing 44 are adapted to fit with and affix the framing rims of adjacent light fixtures 8. The space between the first front wing 14 and first back wing 18 is dimensioned to fit over the upright stem of a standard T-bar 4 of a suspended ceiling system. Similarly, the second back wing 20 is spaced from the second front wing 16 and the third front wing 44 is spaced from the third back wing 48 to fit over the vertical stems of the intersecting right angle T-bar of a standard suspended ceiling system.

The T-shape clamp 40 is designed to handle situations where there are adjacent rectangular light fixtures.

FIG. 8 also illustrates an upright tab 42 formed in the free end of first lip 22. This tab 42, when installed in a suspended ceiling system is bent down so that it aligns with lip 22. However, if tab 42 is not bent down, it lifts the rim of the light fixture and an inspector can quickly see from below that the clamp 40 has not been installed correctly.

Figure 9:
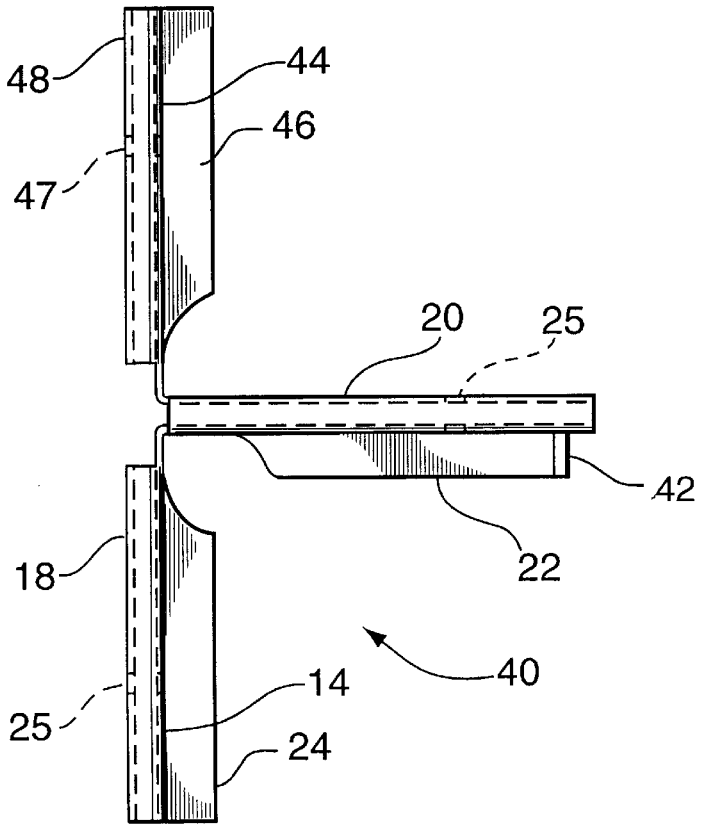
FIG. 9 illustrates a top view of the "T-shape" seismic fixture clamp.

As seen in FIG. 9, which shows a top view of the T-shape seismic fixture clamp 40, the rear exterior corner of the intersection between the first front wing 14 and first back wing 18, and the second front wing 16 and second back wing 20, and the third front wing 44 and third back wing 48, is cut away. This enables the seismic fixture clamp 40 to receive and fit over the stems of the longitudinal and lateral T-bars at the intersection between these T-bars, as shown in FIG. 1. As can also be seen in FIG. 4, the first lip 24 extends inwardly to the interior and to the right (as seen in FIG. 9) from the base of first front wing 14, the second lip 22 extends to the interior and downwardly (as seen in FIG. 9) from the base of second front wing 16 and the third lip 46 extends to the right from third front wing 44. The screw holes 25 and 47 are shown in dotted configuration in the two wings 14 and 16.

It will be understood that the T-shape seismic fixture clamp 40 as illustrated in FIGS. 8 and 9 can be reversed in configuration to provide a left-hand configuration instead of a right hand configuration to fit specific situations.

EXAMPLE

Prototypes of the seismic fixture clamps according to the invention have been constructed. Specifically, four prototypes of the clamp were secured with screws at the four intersecting corners of a conventional demonstration-type suspended ceiling system, comprising lateral and longitudinal T-bars, and a standard 1 ft.×4 ft. fluorescent light fixture. The suspended ceiling system, with the light fixture, and the four prototype seismic fixture clamps were then placed on a standard shaking unit, to simulate earthquake conditions. The shaking unit was then activated, and the system was shaken strongly. Even when forces similar to seismic shocks of a magnitude of 7 on the Richter Scale were imposed, the four seismic fixture clamps and screws held the light fixture in place and the light fixture did not separate from the longitudinal and lateral intersecting T-bars. Nor did the T-bars separate from one another. It follows, therefore, that when the seismic fixture clamps are used in practice, the T-bars will not twist or separate and the light fixture will not separate from the suspended ceiling system and drop to the floor, potentially causing serious injury to a person.

It would only be when the entire suspended ceiling system shook loose and dropped, that the light fixture would fall along with the suspended ceiling system. This same situation would also occur where seismic code wires or chains were used.

In fact, conventional seismic approved wires and chains securing light fixtures to ceilings were tested under similar conditions, and it was noted that they actually contributed to the destruction of the suspended T-bar structure because the light fixtures and the intersecting T-bars moved independently. The seismic fixture clamp according to the invention therefore proved to be as reliable as Seismic Building Code approved wires and chains. The seismic fixture clamp according to the invention should have no difficulty passing the seismic force standards of a building code.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A seismic fixture clamp for use in affixing fixtures to T-bars of a suspension ceiling system comprising:

(a) a first front wing;

(b) a second front wing connected to and extending at right angles to the first front wing;

(c) a first back wing connected to and spaced from the first front wing;

(d) a second back wing connected to and spaced from the second front wing, said second back wing extending at right angles from the first front wing and first back wing;

(e) a third front wing and a third back wing connected to the first front wing or the first back wing or the second front wing or the second back wing;

(f) a first support lip extending inwardly in the direction of the second front wing, to the interior of the right angle, connected to the base of the first front wing; and (g) a second support lip extending inwardly in the direction of the first front wing to the interior of the right angle connected to the base of the second front wing, wherein said first and second support lips are capable of supporting a fixture.

2. A seismic fixture clamp as claimed in claim 1 wherein the elevation of the first support lip is above the elevation of the second support lip.

3. A seismic fixture clamp as claimed in claim 1 wherein the first front wing and the first back wing are connected together in the form of an inverted "U".

4. A seismic fixture clamp as claimed in claim 3 wherein the second front wing and the second back wing are connected together in the form of an inverted "U".

5. A seismic fixture clamp as claimed in claim 2 wherein the first support lip is positioned at an elevation above the second support lip to form a space between the first support lip and the second support lip.

6. A seismic fixture clamp as claimed in claim 4 wherein the first front wing is parallel with the first back wing and the second front wing is parallel with the second back wing.

7. A seismic fixture clamp as claimed in claim 4 wherein aligned screw holes are present in the first front wing and first back wing, and the second front wing and the second back wing.

8. A seismic fixture clamp as claimed in claim 4 including aligned stabilizing wire holes in the second front wing and second back wing.

9. A seismic fixture clamp as claimed in claim 1 wherein the clamp has a T-shape.

10. A seismic fixture clamp as claimed in claim 1 including a third support lip affixed to the third front or back wing.

11. A seismic fixture clamp as claimed in claim 1 including an upright tab formed in the first support lip.

* * * * *